United States Patent [19]

Jost

[11] 4,095,694

[45] Jun. 20, 1978

[54] CONTAINER FOR PHOTOGRAPHS

[75] Inventor: Jochen F. Jost, Essen, Germany

[73] Assignee: Filmosto-Projektion Johannes Jost GmbH & Co., Essen, Germany

[21] Appl. No.: 710,673

[22] Filed: Aug. 2, 1976

[30] Foreign Application Priority Data

| | | |
|---|---|---|
| Aug. 2, 1975 | Germany | 2534678 |
| May 3, 1976 | Germany | 2619059 |

[51] Int. Cl.[2] ..... B65D 85/48

[52] U.S. Cl. ..... 206/455; 206/45.34

[58] Field of Search ..... 206/449–456, 206/215, 45.34

[56] References Cited

U.S. PATENT DOCUMENTS

| | | | |
|---|---|---|---|
| 2,354,706 | 8/1944 | Rulon | 206/455 |
| 3,508,484 | 4/1970 | Hickey | 206/455 |
| 3,550,763 | 12/1970 | Rushlow | 206/45.34 |
| 3,612,335 | 10/1971 | Schurman | 206/45.34 |

FOREIGN PATENT DOCUMENTS

| | | | |
|---|---|---|---|
| 291,740 | 12/1931 | Italy | 206/455 |

*Primary Examiner*—Herbert F. Ross

[57] ABSTRACT

A container for containing photographs and associated strips of negatives formed from a plastics material housing having one rectangular compartment for containing photographs and a second compartment for accommodating strips of negatives. The container is a flat container having a pivotally mounted lid which constitutes substantially all of one flat side of the container, and the lid may be opened to provide access to at least one compartment. The lid is formed at least partially from a transparent material so that a photograph located behind the transparent part of the lid may be seen. The two compartments are separated by a flange which projects into the interior of the container when the container is closed and the flange forms a stop abutment for photographs located in the appropriate commpartment. In preferred embodiments of the invention a further compartment is confined in the lid and is closed by a transparent plate-shaped insert, the further compartment being adapted to contain a single photograph which is visible through the plate shaped insert. The interior container may readily be placed in a pocket.

23 Claims, 8 Drawing Figures

CONTAINER FOR PHOTOGRAPHS

Figure 1:
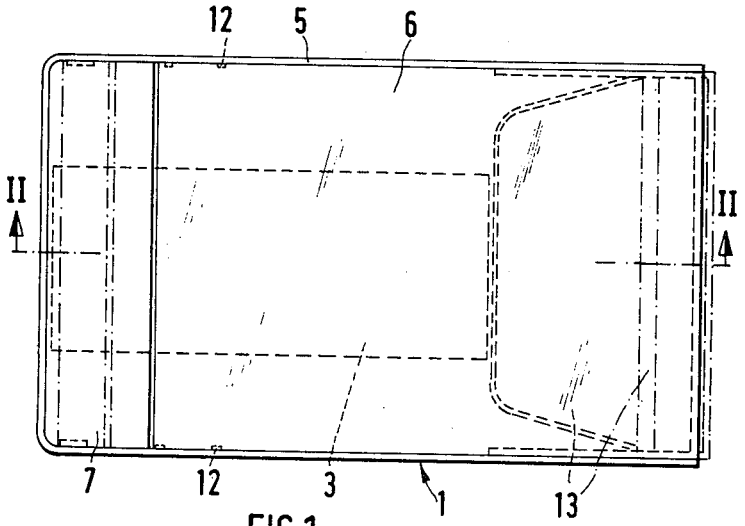

This invention relates to a container for photographs and more particularly relates to a container adapted to contain photographs and an associated strip of negatives.

It has been proposed to provide a container for photographs and an associated strip of negatives, the container having two opposed flat sides and a substantially rectangular compartment for receiving the photographs, the container having a pivotable lid which extends over substantially all of one flat side of the compartment. Such prior proposed containers have been in the form of cardboard boxes and have recently been offered to amateur photographers for the purpose of replacing the conventional picture wallets for the storage of photographs and the associated strips of negatives. Such prior proposed containers which have a compartment for receiving photographs and an adjacent lid which is pivotable with respect to the compartment only have decorative advantages when compared with the conventional paper wallets. The lid part of such a prior proposed container has a window-like opening through which a substantial portion of a photograph situated at the top of the stack of photographs contained within the compartment may be viewed. This visible section of the photograph facilitates recognition of the particular series of photographs which are stored within the container, but the opening within the container permits dust to enter the container and possibly damage the photographs contained therein. A further disadvantage of the prior proposed container is that the dimensions thereof must be determined not only with regard to the overall size of the photograph to be stored therein, but also with regard to the overall length of the strip of negatives. Like conventional photograph wallets the previously proposed container must therefore have a length of at least 25 cm because of the relatively long length of a strip of negatives, as utilised in practice. Thus the strip of negatives extend beyond any compartment provided to accommodate the photographs by considerable degree, thus making the container relatively long.

In an entirely different field it has been previously proposed to provide self-supporting frames for supporting individual pictures or photographs, and some embodiments of such frames are capable of accommodating pictures of photographs of the same format in a serial configuration. The visible photograph or photographs are maintained in flat contact with the rear surface of a transparent or translucent plate of plastics material or glass and the entire plate is surrounded by a frame. The frame may be retained in an elevated position by means of a foot or other such support provided at the end of the frame. Frames of this kind are suitable for receiving one photograph or a series of photographs but are not really suitable for the combined storage of photographs and the associated strips of negatives.

The present invention seeks to provide an improved container for photographs and a strip of negatives in which the disadvantages of previously described containers are obviated or reduced. In particular the present invention seeks to provide a container which may contain photographs and which expose at least one of the stored photographs to view to permit the precise identity of the photographs stored within the container to be readily recognised.

According to this invention there is provided a container for containing photographs and associated strips of negatives, said container comprising a plastics material housing having a first substantially rectangular compartment for containing photographs and a second compartment for accommodating strips of negatives into which the strips of negatives can be at least partially inserted, the container having two oppositely disposed flat sides, a pivotal lid constituting substantially all one said flat side and being openable to expose at least the said first compartment, the lid being at least partially transparent or translucent so that a photograph located behind the transparent or translucent part of the lid may be visible therethrough.

On the side of the plastics material housing remote from the lid of the first compartment there is preferably at least one flat elongated cavity for receiving sections of strips of negatives, this cavity opening through a gap to the said second compartment which is situated adjacent the first compartment. The second compartment has an internal cross-section which is adequate to accommodate a loop of strip of negatives and the compartment is preferably accessible on at least one side through a lid. By these means it is possible to adopt a relatively small longitudinal dimension for the container even when using strips of negatives of conventional length, ie. of 20 to 24 cm, because the strip of negatives can be folded back in an adequately large loop and can be stored within the appropriate compartment without any risk of kinking or any risk of damaging the emulsion present on the film. The overall length, and thus the width and height of the container can generally be matched to the size of the photographs to be stored, there being a space provided for accommodating a loop of the strip of negatives on one side of the photographs. Superfluous cavities can therefore be eliminated and therefore the quantity of raw material utilised in manufacturing a container in accordance with the present invention able to accommodate photographs of a predetermined size may be minimised. It will be appreciated that an embodiment of the invention may readily be accommodated in the breast pocket of a jacket.

Preferably the first compartment is separated from the second compartment by a flange which projects into the interior of the container when the container is closed, the inwardly projecting flange forming a stop abutment for photographs located in the first compartment.

Preferably a further compartment is defined in the lid of the container in accordance with the invention, the further compartment being defined on one side by a wall which is integral with the lid and on the other side by a plate shaped insert which is movably mounted on the lid and, together with said wall, defines a space for accommodating a photograph. Conveniently the said wall integral with the lid which defines the further compartment may extend inwardly into the container and may separate the further compartment from the first chamber, the insert constituting the transparent or translucent part of the lid. This insert may constitute an inspection window having an area corresponding to the area of a photograph to be mounted within the said further compartment.

Preferably the lid insert is provided with an opaque frame shaped edge and preferably the further compartment is formed as a rectangular indentation in the lid which is open to the outside of the lid, the lid insert comprising a substantially flat panel of transparent or translucent material, the external shape of which substantially corresponds with the external shape of the indentation, the panel being securable to the identation by at least one portion extending from the panel which projects into a side wall of said indentation and engages behind part of the lid.

A construction including such a further compartment in the lid which extends across the first compartment provides the containers with all the advantageous properties of a frame for a photograph and also enables photographs to be stored whilst being completely enclosed. The compact construction of the container is enhanced. A photograph which is to be exhibited is clampled within the further compartment in a plain manner and is visible through the lid insert. The lid insert may readily be removed to permit the photograph to be replaced. In such an embodiment of the invention the insertion of the strip of negatives into the corresponding compartment may be facilitated since only one end of each strip of negatives may be inserted into the compartment, the other end of the strip lying adjacent the lid and being trapped between the lid and a stack of photographs contained within the first compartment when the lid is closed. Thus the strip of negatives is bent through a wider arc than in other embodiments of the invention, with the ends of the strip of negatives being bent back on top of the stack of photographs automatically when the lid is closed. It will be appreciated that the ends of the strip of negatives located over the stack of photographs does not in any way interfere in any way with the viewing of the photograph present in the further compartment.

In a further embodiment of the invention a substantially box shaped flat plastics material container which open on at least one side thereof is provided which is detachably located within the said second compartment. The flat plastics material container is adapted to accommodate a strip of negatives coiled into a flat reel. The width of the flat container need only be the same as that of the strip of the negatives to be inserted therein and it therefore occupies as little space as the strip of negatives which is coiled into a loop. The use of such container offers particularly good protection against damage to the emulsion or damage to the strip of negatives and obviates the previously necessary cutting of the strip of negatives into sections of approximately four to five exposures. The work involved in subsequently processing and copying the film material constituted by the strip of negatives is thus greatly reduced.

In a further preferred embodiment of the invention an indentation is formed in one surface of the container, said indentation having disposed therein a pivotable support foot that is pivotably connected to the container so that the support foot may be located in the indentation or may be permitted to extend outwardly to enable the container to be supported after the manner of a picture. If the container is supported in this manner a picture visible from the exterior of the container may be exhibited in the manner of a picture contained within a picture frame.

Figure 2:
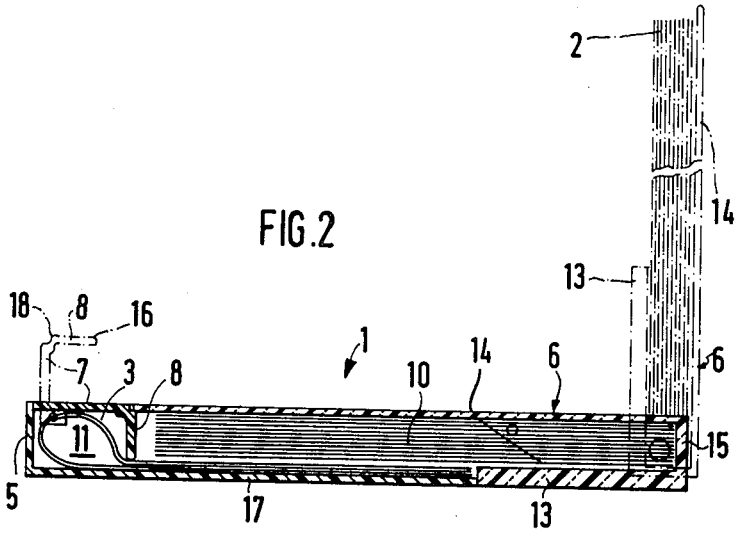

In order that the invention may be more readily understood, and so that further features thereof may be appreciated, the invention will now be described by way of example with reference to the accompanying drawings in which:

FIG. 1 is a plan view of a container in accordance with the invention, the container having two pivotally mounted lids, the lids being shown in the closed position in solid lines and in the fully outward pivoted position in chain lines, parts of the structure usually concealed when the structure is in the closed position being shown in phantom, FIG. 2 is a sectional view taken along line II—II of FIG. 1, also showing the lids in the closed position in solid lines and in the outward pivoted position in chain lines, this figure also illustrating a stack of photographs and a strip of negatives located within the container.

Figure 4:
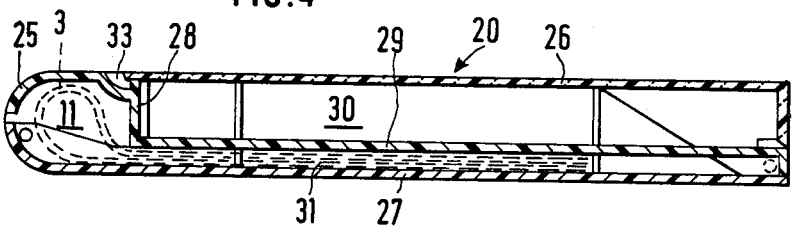
Figure 3:
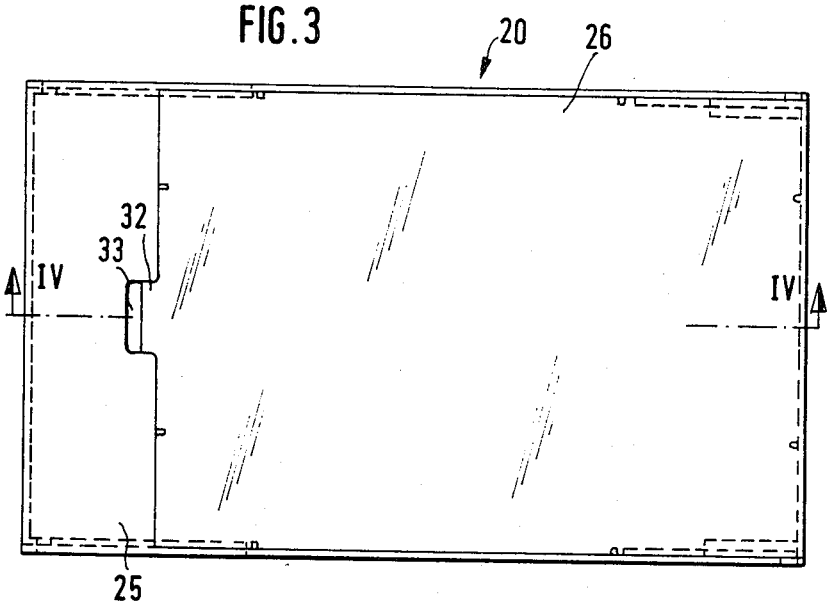
Figure 5:
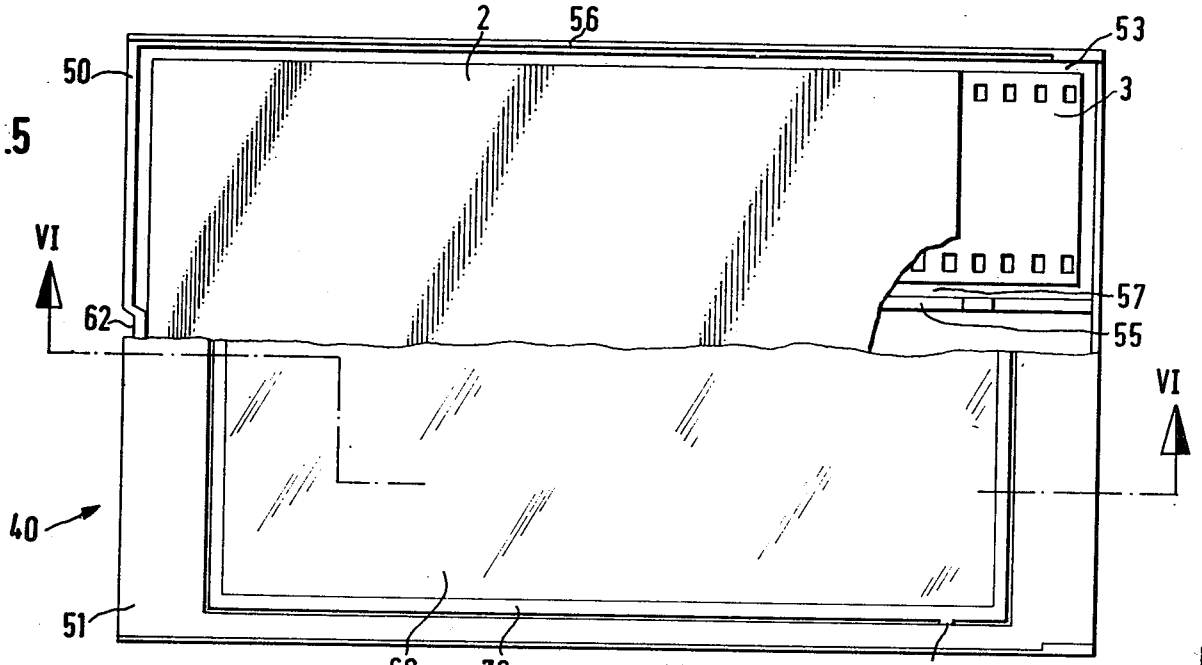
Figure 6:
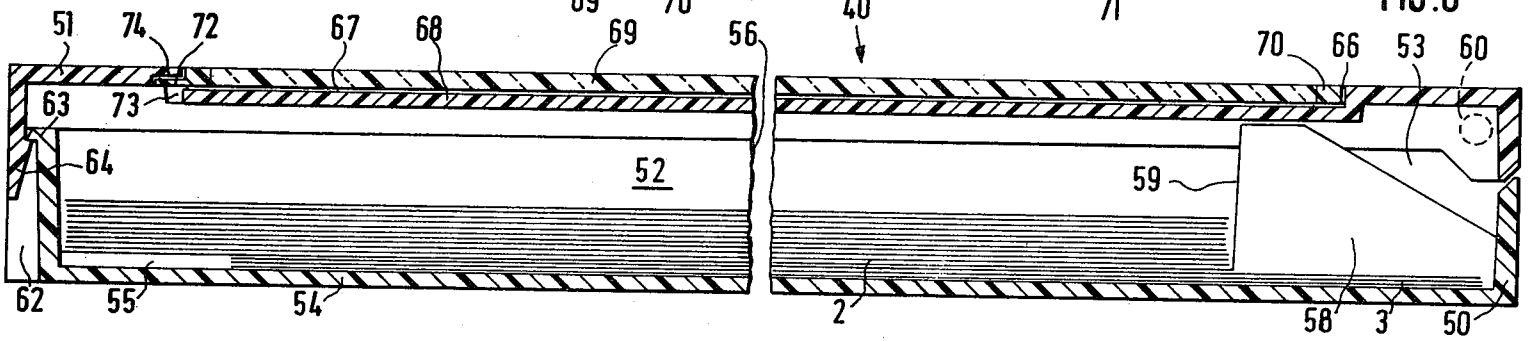
Figure 7:
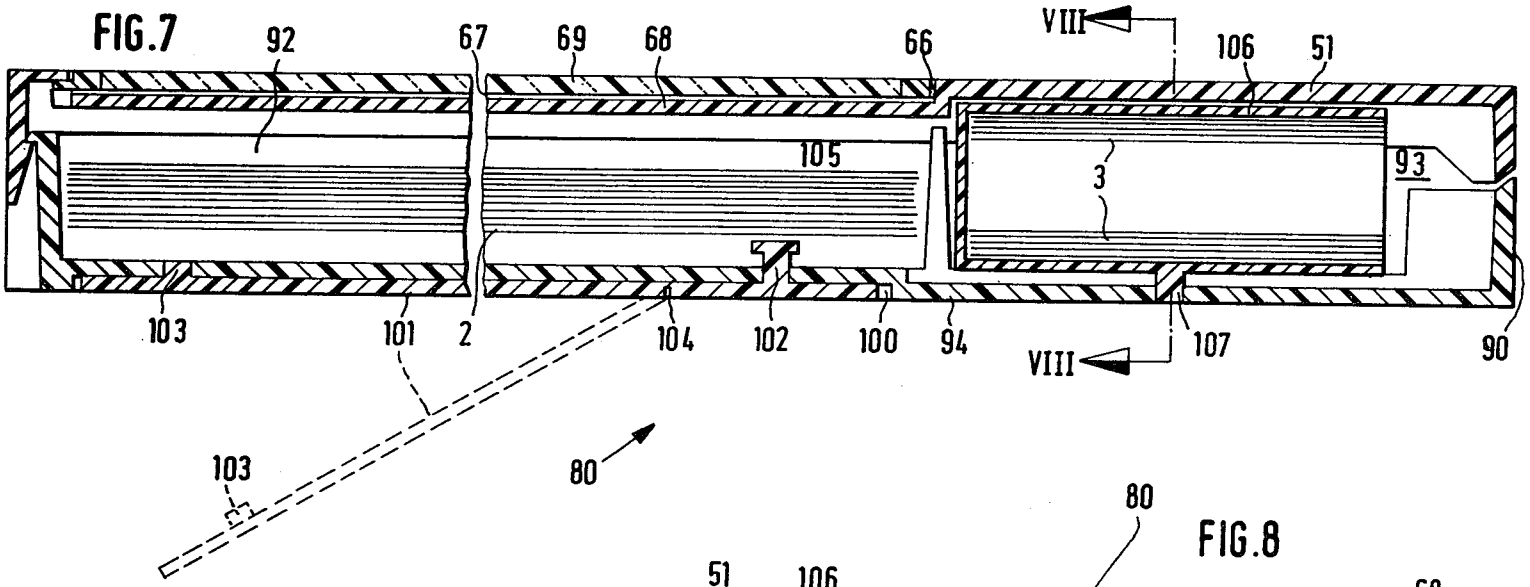
Figure 8:
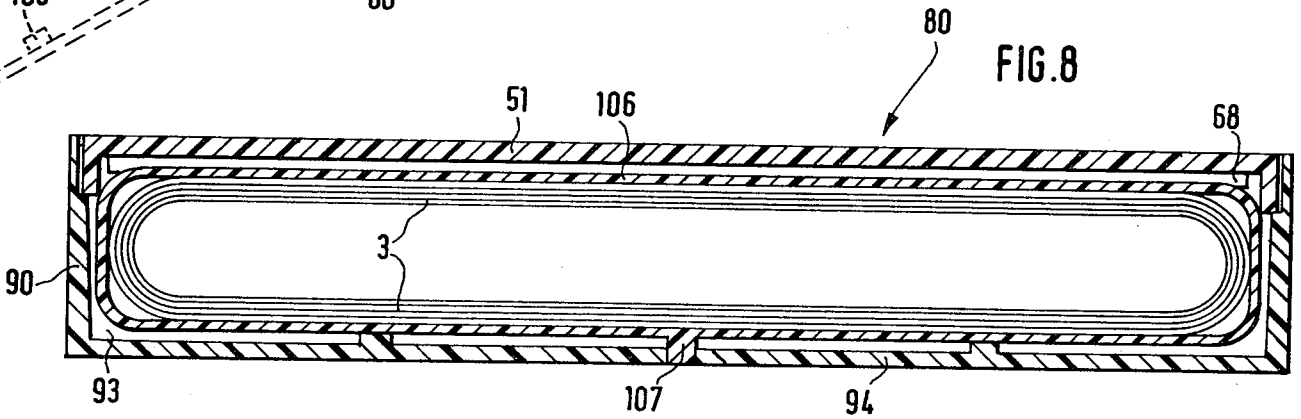

FIG. 3 is a plan view of a second embodiment of a container in accordance with the invention, FIG. 4 is a sectional view taken along line IV—IV of FIG. 3, FIG. 5 is a plan view of a further embodiment of a container in accordance with the invention, with the lid of the container being shown in the closed state, part of the lid being cut away to make the interior of the container visible, FIG. 6 is a sectional view along the line VI—VI of FIG. 5 illustrating a stack of photographs and a stack of strips of negatives arranged within the container, FIG. 7 is a sectional view illustrating yet a further embodiment of a container in accordance with the invention, and FIG. 8 is a cross sectional view along the line VIII—-VIII of FIG. 7.

Referring to FIGS. 1 and 2 of the drawings a container 1 for containing photographs and a strip of negatives is illustrated in the closed state in solid lines and in the fully opened state in chain lines. The container 1 contains a stack of photographs 2 and a strip of negatives 3, and it will be appreciated that the stack of photographs 2 and/or the strip of negatives 3 can be inserted into or removed from the container, when in the open state, without obstruction.

The container 1 comprises a main body portion 5 in the form of a shallow rectangular box which is open at the top and at one longitudinal end face. Two lids 6, 7 are pivotally supported on the body member 5, the pivotal axes of the lids being parallel with each other. The lids 6 and 7 are constructed and arranged so that when the container is in the closed state the lids combine to form a continuous upper surface for the container.

When the container 1 is closed the interior of the container is divided into two chambers 10 and 11 by a flange or partition 8 which extends parallel with the pivotal axes of the lids and which, in actual fact, is formed integrally with the lid 7. The chamber to the righthand side of the flange 8, as shown in FIG. 2, which is the longer chamber, forms a reception compartment for a stack of photographs 2. Short ribs 12 are provided which project from the side walls of the body member 5 into the compartment 10 and form a boundary for the side of the stack of photographs 2. The lid 6 comprises a relatively short bottom member 13 and a top member 14, which forms the lid panel, which is spaced from the bottom portion by a short web 15 which is located adjacent the point of pivotal support of the lid 6 and which, when the lid is closed, forms one end face of the container 1. The top member 14 of the lid 6 forms the lid panel and extends over all of the compartment 10. It will be appreciated that a rectangular compartment is provided between the two members 13 and 14 for receiving a stack of photographs. The stack of photographs is retained between the two members of the lid so that they move together with the lid when the lid is pivoted. It will be appreciated that the photographs can thus be inserted into their appropriate position in the container and be removed therefrom in a simple and convenient manner.

In the embodiment of the invention illustrated in FIGS. 1 and 2 at least part of the member 14 of the lid is constructed of transparent or translucent plastics material so that the picture of the stack of photographs which is adjacent the inner surface of the member 14 is visible even when the container is in the closed state. Of course, the entire lid member 6 may be formed of transparent or translucent plastics material.

The second chamber 11, which is the smaller chamber is dimensioned to receive a looped portion of one or more strips of negative 3. The chamber 11 is dimensioned so that the strip of negatives, and where appropriate, any protective sleeve surrounding the same, can be curved on such a radius that the negative is not damaged in any way, but may still be introduced to the chamber 11. When the container is in the closed state, and contains photographs and strips of negatives the two ends of each strip of negatives are situated under the stack of photographs 2 which are, as described above, retained in the lid 6. The ends of the strip of negatives 3 passes into the compartment 10 and extends beneath the stack of photographs 2, the negative passing through a gap that remains between the bottom edge 16 of the flange 8 and the bottom plate 17 which forms part of the body member 5. To prevent overlapping of the strip of negatives with the lower member 13 of the lid, which would of course hinder the pivoting movement of the lid, the said member 13 is thickened, at least in the peripheral edge region thereof where the member 13 is adjacent the bottom plate 17 to provide an abutment for the ends of the strip of negatives at the transision between the bottom plate 17 and the lower member 13 when the lid is in the closed position.

A recess 18 is formed in the lid 7 at the point where the flange 8 depends from the lid 7. The recess 18 forms a shoulder in which the free edge of the upper member 14 of the lid 6 can engage when both the lids are in the closed position.

It will be appreciated that when both the lids are pivoted inwardly towards the closed position the bottom surface of the lower member 13 of the lid 6 and the bottom surface of the bottom plate 17 if the body member 5 are situated in approximately the same plane.

It will be appreciated that in utilising an embodiment of the invention as illustrated in FIGS. 1 and 2 a stack of photographs and a strip or strips of negatives may be retained within the container, and may be introduced to or removed from the container with great ease. The uppermost photograph in the stack of photographs may be visible at all times to permit the contents of the container to be readily identified.

Referring now to FIGS. 3 and 4 a second embodiment of the invention is illustrated which differs somewhat from the embodiment of the invention illustrated in FIGS. 1 and 2. The primary difference between the two embodiments is that in the embodiment illustrated in FIGS. 3 and 4 two lids, 26 and 27 are provided which are located on opposed flat sides of the container 20, and the strip of negatives 3 are retained within a compartment 11 that is kept entirely separate from the compartment 30 that is provided to accommodate a stack of photographs. The compartments 11 and 31 are separated by two integrally formed flanges 28, 29 which, together with a portion that protrudes partly around the chamber 11 constitute a body member 25. A lid 27 is pivotally connected to the body member 25 and extends over the entire undersurface of the container 20, as shown in the accompanying drawings. This lid 27 defines one wall of a chamber to accommodate a strip of negatives and extends over an enlarged portion of the chamber 11 provided to accommodate a loop in the strip of negatives, together with an extended portion 31 of the chamber that extends underneath the compartment 30, and which is provided to accommodate the ends of strips of negatives which have loops within the chamber 11. The second lid 26, which is also pivotally connected to the body member 25 extends above the compartment 30 which is provided to receive a stack of photographs. The photographs can be introduced to or removed from the compartment 30 when the lid 26 is open. The lid 26, or a portion of the lid 26 corresponding to the area of the picture of the photographs to be inserted into the chamber 30, is made of a transparent or translucent plastics material so that the uppermost picture of the stack of photographs located within the compartment 30 is visible through the lid 26 of the container when that lid is closed.

The lid 26 has an extended nose 32 which projects slightly beyond the flange 28 into a recess 33 formed within the body member 25. The nose 32 provides a suitable finger grip to permit the lid 26 to be opened readily.

It will be appreciated that the embodiment of the invention illustrated in FIGS. 3 and 4 may be utilised in a manner very similar to that described above in connection with FIGS. 1 and 2.

Referring now to FIG. 5 a container 40 is illustrated which is adapted to accommodate a stack of photographs 2 together with strips of negatives 3. The container 40 has a box shaped rectangular reception part 50 which is open at the top, and this part of the container is provided with a single lid pivotally connected thereto and which extends across the entire area of the reception part. The reception part 50 is divided into two chambers 52 and 53 which are situated adjacent to each other. The lefthand and substantially longer chamber 52 is provided to accommodate a stack of photographs 2, and the righthand chamber 53 serves to accommodte strips of negatives 3. Two parallel ribs 55 which have a relatively low height in the regions of the compartment 52, and which are enlarged into a fin like flange in the region of the chamber 53 are formed on the inside of the bottom wall 54 of the reception part 50 and extend at a distance to, and extend at a distance to, and parallel with, the two side walls 56 which define the outer periphery of the two compartments. A shallow trough 57, whose width is such that the strips of negatives 3, placed one upon the other, can be accommodated therein, is defined between each of the two ribs 55 and the side wall 56 adjacent thereto. Thus two such troughs 57 are defined, one at the upper part of the container is illustrated in FIG. 5 and one at the lower part of the container as illustrated in FIG. 5. It will be appreciated that the upper edges of the ribs 55 form a support surface for the stack of photographs 2, the surface being planar and being parallel to the bottom wall 54. Thus the photographs do not enter the two troughs 57.

On the side thereof adjacent the compartment 52 the rib portions which are extended into the fin like flanges 58 have abutment edges 59 extending at right angles to the bottom wall of the container to prevent the stack of photographs 2 located in the compartment 52 from being displaced into the chamber 53 provided for the strips of negatives. Towards the other side thereof the fin like flanges 58 taper in a ramp configuration to prevent the pivotal opening movement of the lid 51 from being hindered. The lid 51 is pivotally mounted on trunnions 60 in the region of the chamber 53.

When the lid 51 is opened photographs 2 may be introduced or removed from the chamber 52 and similarly strips of negatives may be introduced to the position shown in FIG. 6. Depending on the length of the container and the length of the strips of negatives the strips of negatives 3 can be inserted into the film strip chamber in a flat condition or can be curved back into a loop, the loop being accommodated within the chamber 53. Alternatively the strips may be located so that one end thereof is located under the stack of photographs 2, while the other end thereof lies adjacent the undersurface of the lid 51. Then, when the lid is closed the end of the strip of negatives will automatically be moved to lie on top of the stack of photographs 2.

The end wall of the reception part 50 which is remote from the trunnions 60 is provided with a central recess 62 which is provided with a protrusion 63. The lid 51 is provided with a downwardly extending nose 64 having a lip adapted to engage the protrusion 63 to secure the lid in a closed position. By gripping the nose 64 the lid may easily be opened.

The upper part of the lid 51, which extends over the entire area of the container, is provided with a flat rectangular indentation, the dimensions of the indentation corresponding approximately to the area of the compartment 52, the dimensions being at least equal to the exterior dimensions of the photographs 2 which are to be accommodated within the container. The indentation is partly defined by a wall 68 forming part of the lid 51 and a plate shaped insert is provided which can be inserted into the indentation 66, the upper surface of the insert 69 then being flush with the upper surface of the remainder of the lid 51. The wall 68 of the insert 69 together define a compartment 67 which is dimensioned to accommodate a single photograph. The lid insert 69 consists of a transparent or translucent plastics material and is constructed as a rectangular plate. In the region of its outer edges the insert 69 is provided with an opaque region 70 to provide a frame-like appearance. The opaque region may be manufactured by dyeing parts of the transparent material.

A photograph, when inserted into the compartment 67, is retained or clamped in a plane configuration when the lid insert is closed. By a suitable selection of the width of the opaque perimetric edge 70 it is possible that only a portion of the picture of the photograph can be visible through the transparent portion of the lid insert 69.

The lid insert 69 can be mounted by means of a pivoting bearing on the lid 51, so that the lid insert 69 is in the form of a hinged lid mounted on a hinged lid. However, in the embodiment of the invention illustrated in the drawings short noses 71 are integrally formed on oppositely disposed side edges of the lid insert to engage in corresponding recesses in two oppositely disposed side walls of the rectangular indentation 66. A projecting extension 72 is also provided which engages in an opening 73 formed in the adjacent wall of the identation 66 and grips behind a shoulder 74 formed in the lid 51. Thus, in the embodiment of the invention illustrated, initially the projecting extension is inserted behind the shoulder 74 and subsequently the lid is pivoted until the noses 71 integrally engage with the corresponding recesses to secure the lid insert 69 in position. To open the compartment 67, for example when changing or inserting the photograph within the compartment 67, the lid insert is gripped by a suitable edge to release the ratchet noses 71, again permitting the insert 69 to be moved pivotally. When the lid insert 69 is opened it will be appreciated that the insert 69 can be completely detached from the lid 51.

The wall 68 is formed of an opaque plastics material and can take the form of a continuous or an intermittent wall because, to clamp the photograph situated within the compartment 67 in position it is merely necessary that the wall 68 functions as a support surface to withstand a slight contact pressure of the lid insert 69 when the lid insert 69 is inserted flush in the indentation 66.

It will be appreciated that in utilising an embodiment of the invention illustrated in FIGS. 5 and 6 initially a photograph will be inserted in the compartment 67 and subsequently photographs will be inserted within the chamber 52. Thereafter strips of negatives may be inserted within the two channels 57.

Referring now to FIGS. 7 and 8 a container 80 forming a further embodiment of the invention is illustrated in two cross sectional views. The container 80 comprises a box shaped rectangular reception part 90 generally formed of plastics material having two adjacent chambers 92, 93 provided to accommodate, respectively, a stack of photographs and a strip of negatives. The container 80 is also provided with a compartment 67, provided to accommodate a single photograph, and located within a pivotally mounted lid 51. The compartment 57 is closed by a detachable transparent lid insert 69.

On the outside of the bottom wall 94 of the container a shallow indentation is provided into which is inserted an elongate member 101 which constitutes a supporting foot to permit the entire container to be mounted in a substantially upright manner after the fashion of a small picture frame. The supporting foot 101 is pivotally connected to the bottom wall 94 by means of a bearing pin 102 which extends through an opening in the bottom wall 94. The bearing pin 102 which can be constructed, for example, as a screw threaded bolt, is formed so that part of the supporting foot 101 can be raised or pivoted away from the indentation 100 about a pivoting axis and can thus be pivoted to a position in which the supporting foot 101 can support the container when the container is located upright in the manner of a standing picture frame. A plug 103 is integrally formed with the supporting foot 101 and the plug 103 is adapted to engage the corresponding aperture formed in the wall 94 to lock the foot 101 within the recess 100 when the foot is not to be utilised to support the frame. Thus the foot can be secured within the recess 100, the exposed surface of the foot then being flush with the surface of the wall 94. The foot 101 is provided with a weakened portion 104 which defines the point of pivotal movement of the foot 101.

Turning now to the interior of the container a narrow flange 105 is provided to act as a limitation on the compartment 92, the flange 105 being located between the compartment 92 and the compartment 93. Flange 105 can thus be perforated or may merely be constructed as a plurality of pins.

In contrast with the previously described embodiments of the invention, in this particular embodiment the stack of photographs 2 and the strips of negative 3 do not overlap within the container 80. Instead the chamber 93 accommodates a strip of negative as an entire uncut film which may be located, in a coiled state, within a box shaped plastics material container 106, which is open on one side to permit the introduction and removal of the coiled film. The container 106 is detachably mounted within the chamber 93 by means of a connecting pin 107 that can be inserted within an opening provided in the bottom wall 94. However, it is to be appreciated that in other embodiments of the invention the container may be removably inserted within the chamber 93 in many other ways, and may even be inserted within the chamber but not secured to the housing forming the container 80. The container 106 has an overall width corresponding to the width of the strip of negatives 3 so that the latter, which is wound into a shallow coil, is completely surrounded and protected by the walls of the plastics material container 106. The space occupied by the containter 106 in the chamber 93 is only slightly greater than that of the coiled film strip so that the volume of material utilised in the construction of the container 106 is very small. As can be seen by reference to FIG. 8 the internal corners of the container 106 are slightly rounded to correspond to the coiling shape of the strip of film.

The lid 51 of the embodiment of the invention illustrated in FIGS. 7 and 8 is provided with a recess 66 similar to that provided in the embodiment illustrated in FIGS. 5 and 6. It will be of course appreciated that a photograph may be inserted within this particular recess, and the transparent insert 69 will permit the photograph to be viewed when located within the recess. It will be appreciated that when a photograph has been inserted within the recess the entire container may be mounted in an upright position by means of the foot 101 and the photograph may then be viewed.

It will be appreciated that many modifications or alterations may be made to the various embodiments of the invention which have been described above and which are illustrated in the accompanying drawings. For example the lids of all the embodiments of the invention may be secured in their closed positions by means of noses provided with lips adapted to engage with corresponding projections provided at corresponding places. Furthermore, the lids of any of the embodiments of the invention may be provided with compartments corresponding to compartment 67 to provide means for retaining a single photograph independently of the stack of photographs. Furthermore, it will be appreciated that embodiments of the invention may be utilised as frames for photographs, the flat side and end faces conferring self-supporting properties to the container, although feet corresponding to the foot 101 may be provided on all the embodiments of the invention. The complete closure of the container substantially prevents the ingress of dust and thus permits the storage of photographs and film in ideal conditions.

I claim:

1. A container for containing photographs and associated strips of negatives, said container comprising a plastics material housing having means defining a first substantially rectangular compartment with an opening for receiving photographs and means defining a second compartment for accommodating strips of negatives into which the strips of negatives can be at least partially inserted, the container having two oppositely disposed flat sides, a pivotal lid adapted to cover said opening on one of said flat sides and being openable to expose at least said first compartment through said opening, said lid comprising identification means having a further compartment therein, the further compartment being defined on a front side of said lid by a first wall and on a back side of said lid by a second wall forming a space therebetween for accommodating a photograph, one of said first and second walls being integral with the lid and the other one being formed by an insert which is movably mounted on the lid, at least part of said first wall being formed from a material selected from the group comprising transparent materials and translucent materials, whereby a photograph identifying the photographs and strips of negatives contained in said first and second compartments respectively may be located within said further compartment so as to be visible through the portion of the lid formed from the selected material.

2. A container according to claim 1, wherein said second wall is integral with the pivotal lid defining the further compartment and extends inwardly into the container so as to separate the further compartment from said first compartment when the lid is located to cover said opening, the insert constituting the part of the lid formed from the selected material.

3. A container according to claim 1, wherein the first compartment is separated from the second campartment by a flange which projects into the interior of the container when the container is closed, said inwardly projecting flange forming a stop abutment for photographs located in the said first compartment.

4. A container according to claim 2, wherein the lid insert is provided with an opaque frame shaped edge.

5. A container according to claim 5, wherein the said further compartment is formed as a rectangular indentation in the lid which is open to the outside of the lid, the lid insert comprising a substantially flat panel of plastics material, the external shape of which substantially corresponds with the external shape of the indentation, the lid insert being securable to the indentation by at least one portion extending from the lid insert which projects into a side wall of said indentation and engages behind part of lid.

6. A container according to claim 3, comprising means defining at least one flat elongate cavity for accommodating sections of strips of negative, the elongate cavity being provided adjacent the side of the box beneath the said first compartment and on the side thereof remote from the lid, the cavity being in communication with the said second compartment being adjacent said first compartment, and having an internal cross section such that a strip of negatives in looped configuration may be inserted into the compartment, the ends of the strips entering said cavity, the second compartment being defined on at least one side thereof by a lid which is pivotally supported so as to be movable to an open position in which the said second compartment is exposed.

7. A container according to claim 6, wherein the lid associated with the first compartment is of channel section, one member forming an upper lid panel which extends across the entire area of the first compartment and a second member being spaced from the frist member and being of less area than the first member, so that a stack of photographs may be introduced between the channel defined by the first member and the second member.

8. A container according to claim 7, wherein the lid includes a web extending between the first member and the second member, the web forming part of the short side wall of a container.

9. A container according to claim 7, wherein the second member of the lid can be pivoted into and out of a complementary opening provided in the lower surface of the container, so that the said first member and the said under surface of the container comprise a substantially flat surface when the lid is closed.

10. A container according to claim 3, wherein a second lid is provided on the second compartment, the two lids being supported on parallel axes at opposite end regions of the plastics material box.

11. A container according to claim 10, wherein both lids are movable pivoted outwardly with respect to the top of the container, a partition or flange being formed by the free end portion of one lid, to form the flange between the first compartment and the second compartment.

12. A container according to claim 1, wherein the first compartment and the second compartment are spanned by a continuous partially transparent lid which is pivotally supported on the end region of the plastics box adjacent to the second compartment.

13. A container according to claim 10, wherein the two lids are located on opposed sides of the container, there being a flat cavity for accommodating strips of negatives extending substantially over the entire length of the container and communicating with the second compartment, the flat cavity being located beneath the first compartment and being separated therefrom by a flange, one of said lids extending over the second compartment and the said elongate cavity.

14. A container according to claim 1, wherein two ribs are formed on one surface of the container to form support surfaces for photographs to be stacked within the first compartment in a plane which is parallel to the bottom wall of the container, the ribs being parallel with and spaced from the side walls of the container to define troughs open to the second compartment and having at least the width of a strip of negatives to accommodate said negatives.

15. A container according to claim 14, wherein one side of the first compartment is defined by at least one wall like stop abutment which projects inwardly from the bottom surface of the container.

16. A container according to claim 1 having at least one wall provided with flat external surface which functions as a support surface.

17. A container according to claim 1, wherein indentation is formed in one surface having disposed therein a pivotable support foot that is pivotably connected to the container so that the support foot may be located in the indentation or may be permitted to extend outwardly to enable the container to be supported after the manner of a picture.

18. A container according to claim 17, wherein a bearing pin is mounted on a flat portion of the support foot, the bearing pin extending through an opening formed in the bottom wall of the plastics container to secure the support foot to the container.

19. A container according to claim 1, wherein a substantially box shaped flat plastics material container open on at least one side thereof is detachably disposed in the second compartment, the flat plastics material container being adapted to accommodate a strip of negatives coiled into a flat reel.

20. A container according to claim 19, wherein the said flat plastics material container has slightly rounded internal edges and is detachably mounted by means of an externally formed connecting stud provided on the bottom wall of the said flat container.

21. A container for containing photographs and associated strips of negatives, said container comprising a plastics material housing having means defining a first substantially rectangular compartment for containing photographs and means defining a second compartment for accomodating strips of negatives into which the strips of negatives can be at least partially inserted, the container having two oppositely disposed flat sides, a pivotal lid constituting substantially all of one said flat side and being openable to expose at least said first compartment, the second compartment communicating with an elongate cavity being provided adjacent the side of the housing beneath the first compartment and on the side thereof remote from the lid, the second compartment having an internal cross section such that a strip of negatives in looped configuration may be inserted into the compartment with the ends of the strips entering the cavity, the second compartment being defined on at least one side thereof by a lid which is pivotally supported so as to be movable to an open position in which the second compartment is exposed, the lid comprising means defining a further compartment therein, the further compartment being defined on one side by a wall which is integral with the lid and on the other side by a plate shaped insert which is movably mounted on the lid and together with said wall defines a space for accommodating a photograph, at least part of the lid being formed from a material selected from the group comprising transparent materials and translucent materials so that a photograph located within said further compartment may be visible through the portion of the lid formed from the selected material.

22. A container according to claim 21, wherein the plate shaped insert is formed of a material selected from the group comprising transparent materials and translucent materials.

23. A container according to claim 21, wherein the said further compartment is formed as a rectangular indentation in the lid which is open to the outside of the lid, the lid insert comprising a substantially flat panel of plastics material, the external shape of which substantially corresponds with the external shape of the indentation, the lid insert being securable to the indentation by at least one portion extending from the lid insert which projects into a side wall of said indentation and engages behind part of the lid.

* * * * *